United States Patent [19]

Qureshi

[11] 4,060,197

[45] Nov. 29, 1977

[54] RAIL FASTENER ASSEMBLY

[75] Inventor: Khurshid Ahmed Qureshi, Bolingbrook, Ill.

[73] Assignee: Portec, Inc., Oak Brook, Ill.

[21] Appl. No.: 734,537

[22] Filed: Oct. 21, 1976

[51] Int. Cl.[2] ..... E01B 9/36

[52] U.S. Cl. ..... 238/338; 238/287; 238/304; 238/310

[58] Field of Search ..... 238/209, 210, 215, 216, 238/217, 264, 287, 294, 295, 296, 304, 306, 307, 310, 315, 338

[56] References Cited

U.S. PATENT DOCUMENTS

| | | | |
|---|---|---|---|
| 1,055,218 | 3/1913 | Petersen | 238/304 |
| 1,864,665 | 6/1932 | Northey et al. | 238/338 X |
| 2,140,891 | 12/1938 | Boyce | 238/304 X |
| 2,167,870 | 8/1939 | Boyce | 238/338 |
| 3,240,429 | 3/1966 | Spencer | 238/315 |

FOREIGN PATENT DOCUMENTS

| | | | |
|---|---|---|---|
| 237,202 | 7/1925 | United Kingdom | 238/304 |
| 608,386 | 9/1948 | United Kingdom | 238/306 |

*Primary Examiner*—Robert J. Spar
*Assistant Examiner*—Randolph A. Reese
*Attorney, Agent, or Firm*—Emory L. Groff, Jr.

[57] ABSTRACT

A rail fastener assembly includes a restraining block to resist rail overturning and which is disposed atop a tie plate having a raised shoulder adjacent a rail seat section. The curved upper surface of the shoulder is engaged by a mating curved lower surface on the block to position a lip portion on the block in overlying relationship to the rail base flange. Means vertically extend downwardly from the block and cooperate with two spike holes formed through the tie plate shoulder to secure the block relative the tie plate. A rail anchor may be attached to the rail base adjacent the tie plate to provide a complete rail-to-tie fastener assembly.

10 Claims, 6 Drawing Figures

RAIL FASTENER ASSEMBLY

This invention relates generally to railway devices and more particularly, to an improved rail fastener assembly including a restraining member fixedly disposed upon a tie plate and including means cooperating with the two spike holes normally provided in a tie plate adjacent the edge of the rail flange. A complete rail-to-tie fastener assembly may be provided by including a suitable rail anchor on the rail base adjacent one or both edges of the tie plate.

Those skilled in the art are fully aware of the numerous prior examples of rail clips or restraining members adapted to be anchored to either a tie plate or tie and including a lip portion extending over the top of the rail base flange and intended to inhibit the vertical displacement of the rail base or preclude overturning of the rail. Such devices may either directly contact the rail flange or be slightly elevated thereabove so as to permit the usual rail wave motion to occur, which latter type is referred to as a "floating" fastener.

In the present instance a floating rail fastener is provided comprising an integral restraining block having a lower surface especially configured to cooperate with the upper surface of a tie plate provided with a raised shoulder adjacent the rail seat section and further includes means cooperating with the two existing spike holes formed in the tie plate through its raised shoulder on either side of the rail seat section. In one form of the invention the main body of the restraining block is coextensive with the two tie plate spike holes and is anchored to the upper surface of the tie plate by means of non-yielding type fasteners disposed through both of the spike holes and vertically aligned holes in the body of the restraining block. In a further modification of the present invention a restraining block is formed with a main body overlying one of the tie plate spike holes and includes means extending toward the other spike hole and provided with a depending lug disposed within this second spike hole and which combined with a non-yielding fastener disposed through the main body of the block and cooperating with the first tie plate spike hole, provides a significantly improved anchorage of the restraining block to the tie plate.

Accordingly, one of the primary objects of the present invention is to provide an improved rail fastener including a restraining block overlying a substantial longitudinal extent of a tie plate having a raised shoulder adjacent the rail seat section thereof and including rigid means positively anchoring the block to the raised shoulder area of the tie plate, which means cooperates with two spike holes formed through said tie plate raised shoulder.

A further object of the present invention is to provide an improved rail fastener comprising an integral restraining block having a main body portion including a lower surface comprising a compound curvature cooperating in a mating manner with a compound curvature as provided by a tie plate having a raised shoulder thereon and including means on the restraining block cooperating with two spike holes formed through said tie plate raised shoulder.

An additional object of the present invention is to provide an improved rail fastener including a restraining block having a curved lower surface cooperating with a mating surface as provided by a tie plate including a raised shoulder and wherein a fastener disposed through the restraining block cooperates with one spike hole formed through the raised shoulder portion of the tie plate while the block is provided with a longitudinally extending arm having a depending lug engageable within a second spike hole formed through the same tie plate raised shoulder.

Still another object of the present invention is to provide an improved rail fastener including a restraining block having a main body portion including a lower curved surface mating with a curved surface as provided by a tie plate having a raised shoulder, which restraining block overlies two spike holes formed through the tie plate raised shoulder and including non-yielding fastener means disposed through the two spike holes and the restraining block.

A further object of the present invention is to provide an improved rail fastener including a restraining block having a main body portion including a lower curved surface mating with a curved surface as provided by a tie plate having a raised shoulder, which restraining block is secured to the rail base adjacent one or both edges of the tie plate to form a complete rail-to-tie fastener assembly.

With these and other objects in view which will more readily appear as the nature of the invention is better understood, the invention consists in the novel construction, combination and arrangement of parts hereinafter more fully described, illustrated and claimed.

A preferred and practical embodiment of the invention is shown in the accompanying drawings in which.

Similar reference characters are used to designate corresponding parts throughout the several figures of the drawings.

Figure 1:
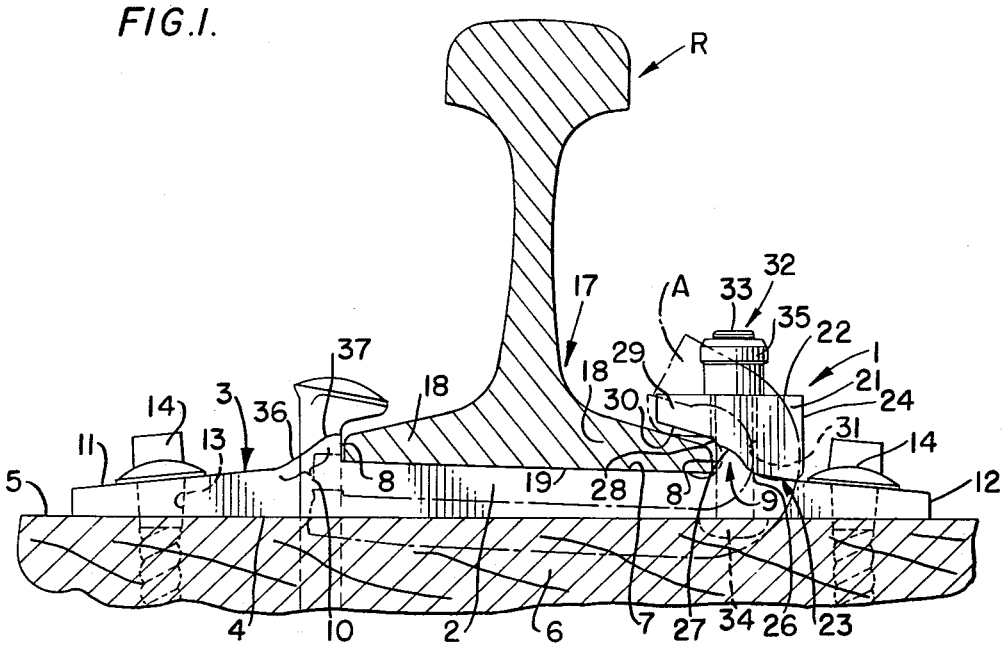
FIG. 1 is a vertical end elevation, partly in section, of the present invention.
Figure 2:
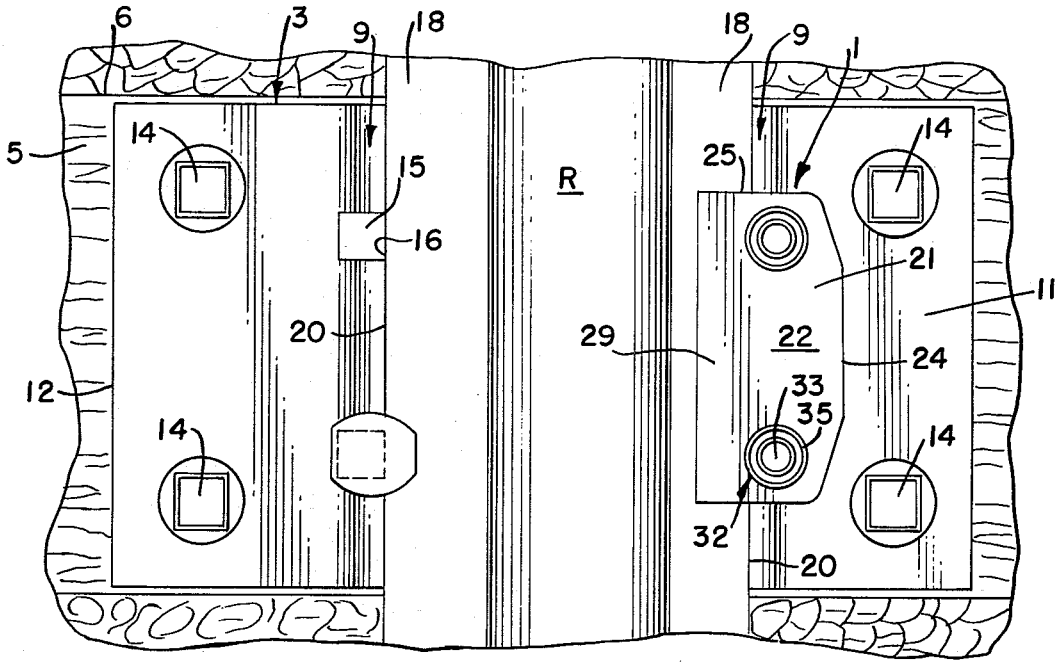
FIG. 2 is a top plan view of the structure illustrated in FIG. 1.

Referring now to the drawings, particularly FIGS. 1 and 2, the present invention will be seen to comprise a rail clip or rail restraining block generally designated 1, as utilized in an installation including a rail R disposed upon the rail seat section 2 of a tie plate, generally designated 3. This tie plate includes a planar bottom surface 4 disposed upon the upper surface 5 of a suitable crosstie 6. The upper portion of the tie plate 3 includes the medial rail seat section 2 having a planar rail supporting surface 7 which may be canted as illustrated in FIG. 1 and which is bounded on opposite lateral sides thereof by the two opposed vertical faces 8—8 formed by the raised shoulders 9. The remaining portion of the upper surface of the tie plate includes on either side of the rail seat section 2, a curved upper surface 10 forming the top of the raised shoulder 9 and extending outwardly to the planar top surface 11 leading to the outer edges 12 of the tie plate. The tie plate includes a plurality of holes 13 adjacent the outer edges 12 and disposed through the planar top surfaces 11 for the reception of any suitable tie plate fastener means 14 such as the illustrated screw spikes which are inserted through the holes 13 and disposed within the crosstie 6 to anchor the tie plate against longitudinal and transverse displacement relative the crosstie.

A pair of conventional spike holes 15 are provided through the tie plate in the area of each of the two raised shoulders 9—9 thereof and include an inner surface 16 substantially vertically aligned with the shoulder vertical faces 8 of the respective tie plate shoulders 9 as shown in both FIGS. 1 and 2 of the drawings. As is well known to those skilled in this art, rail spikes disposed through a tie plate adjacent the edges of a rail flange are intended principally to insure retention of rail gauge and the head of a rail spike cannot be relied upon to prevent overturning of the rail inasmuch as the usual wave motion of the rail pulls the spike upwardly as illustrated in the left hand portion of FIG. 1 of the drawings. In the present arrangement the gauge of the rail R is assured by means of the vertical faces 8 of the tie plate shoulders 9, which define the lateral limit of the rail supporting surface 7. It will be appreciated that the attachment of the instant rail fastener is dependent upon the provision of the spike holes 13, at least along one side of the tie plate 3.

With a rail base 17 located on the tie plate 3 the two flanges 18—18 thereof will be disposed upon the rail seat section 2 with the rail base undersurface 19 substantially overlying the extent of the supporting surface 7 such that the rail flange lateral edges 20 will be juxtaposed the vertical faces 8 of the two shoulders 9. The restraining block 1 is then installed as shown in FIGS. 1 and 2 of the drawings and the specific construction of this block may now be related.

The restraining block 1 includes an integral rigid unit comprising a main body portion 21 of a longitudinal extent which is greater than the distance between the two tie plate spike holes 15—15 passing through the raised shoulder 9. The main body portion 21 extends from the planar top surface 22 to a lower curved bearing surface 23 and is laterally bounded by the outer wall 24 and two end walls 25—25. The lower bearing surface 23 defines a compound curve intended to cooperate, in a mating manner, with the juxtaposed surface 10 of the tie plate and will be seen to include an outer convex portion 26 adjacent an inner concave portion 27, the latter of which terminates adjacent the vertical inwardly facing shoulder 28.

The main body portion 21 is combined with the inwardly extending lip portion 29 to form the restraining block 1, which lip portion includes a bottom surface 30 disposed substantially parallel to the top of the rail base flange 18 and preferably spaced above the same.

Formed through the material of the main body portion 21 of the restraining block are a pair of vertical holes 31—31, which holes are vertically aligned with the two spike holes 15—15 therebeneath and it is through each of these combined vertically aligned holes that suitable anchor means such as the fastener 32 is disposed. Preferably, a non-yielding fastener is utilized, such as a Huck fastener, comprising a base element 33 extending from a suitable head 34 beneath the tie plate 3 upwardly through the aligned spike hole 15 and restraining block hole 31 to a point well above the block planar top surface 22 and to which is secured the machine applied element 35.

By the construction of the lower curved bearing surface 23 of the restraining block and its cooperation with the mating configuration of the tie plate, it will be understood that upon application of the fasteners 32—32, the restraining block will be rigidly anchored with respect to the tie plate such that vertical displacement of the rail flange 18 is disposed beneath the restraining block lip portion 30 will be positively limited to the amount of space between the top of this rail base flange and the bottom surface 30 of the lip 29. The referenced mating engagement between the bearing surface 23 of the restraining block and the tie plate curved upper surface 10 is insured by means of the concave upper surface 36 and convex upper surface 37 of the curved upper surface 10 of the tie plate.

FIGS. 3-6 of the drawings will be seen to illustrate a modified form of restraining block generally designated 1' and which is intended to cooperate with both of the spike holes 15—15 on one side of the same type of tie plate 3 as illustrated in FIGS. 1 and 2, but which differentiates from the restraining block 1 in a significant manner in that the main body portion of this block overlies the tie plate only in an area extending over and to both sides of one of the spike holes 15. Thus the cross section of the main body portion 38 of the restraining block 1' is constructed similar to that of the main body portion 21 of the block 1 and the single vertical hole 31 therethrough will be seen to be disposed through the medial portion of the main body portion 38, that is, substantially halfway between the end wall 25 and the opposite intermediate wall 39. Longitudinally extending from the upper portion of the intermediate wall 39 is an arm 40, the upper surface of which will be seen to be co-planar with the block top surface 22. The undersurface 41 of the arm 40 is spaced well above the medial height of the block main body portion 38 and is joined to a downwardly extending anchor member or lug 42 at the distal end of the arm 40, which lug is preferably cylindrical in horizontal cross-section and extends downwardly from the arm 40 to a point well below the plane of the lower bearing surface 23 of the block as shown most clearly in FIG. 5 of the drawings.

Installation of the block 1' is achieved by utilizing an appropriate fastener 32 through one of the spike holes 15 and the vertical hole 31 of the block and by inserting the bottom 43 of the lug 42 into the other spike hole 15 such that when the fastener 32 is fully applied the outer convex portion 26 and inner concave portion 27 of the block will tightly engage the mating convex surface 37 and concave surface 36 of the tie plate below the main body portion 38 while the lug 42 will be captively disposed within the other spike hole 15, thereby precluding any angular displacement of the restraining block and insuring rigid placement of the lip portion 29 above the juxtaposed rail base flange 18.

Figure 3:
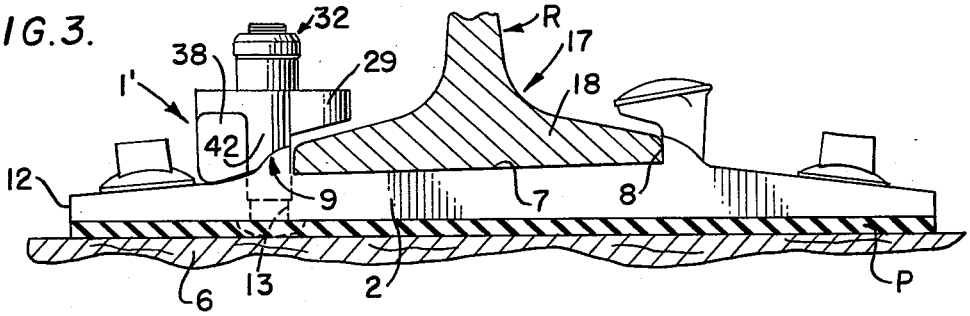
FIG. 3 is a fragmentary end elevation, partly in section, of a modification of the rail fastener shown in FIG. 1.
Figure 4:
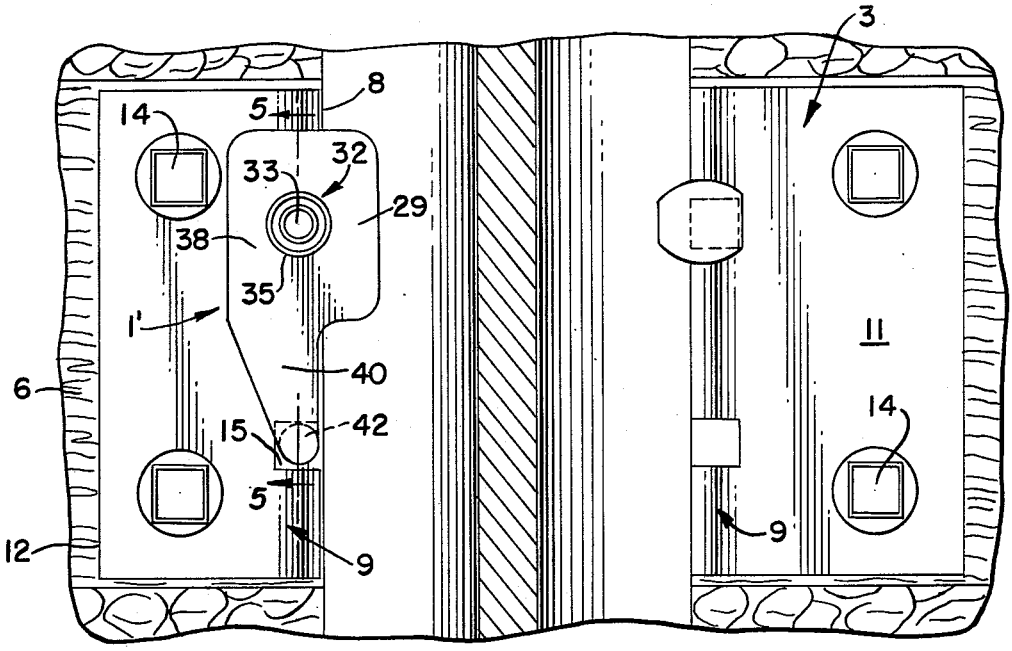
FIG. 4 is a top plan view of the structure of FIG. 3.
Figure 5:
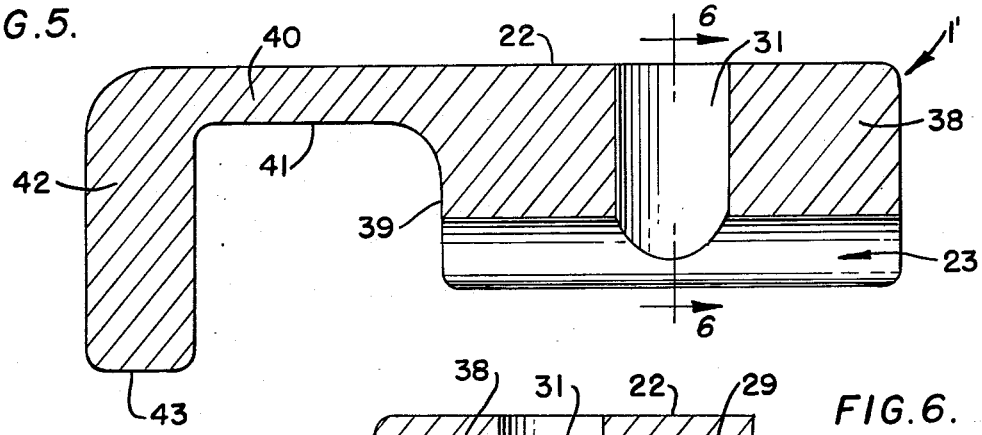
FIG. 5 is an enlarged longitudinal sectional view taken along the lines 5—5 of FIG. 4.
Figure 6:
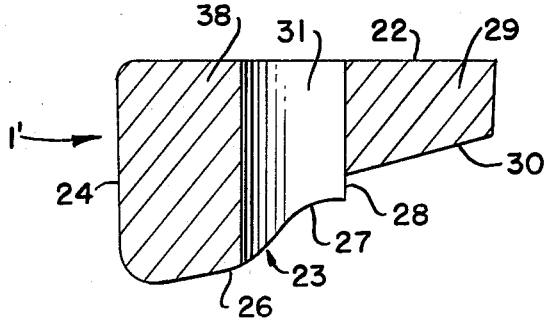
FIG. 6 is a transverse sectional view taken along the lines 6—6 of FIG. 5.

With the block 1 or 1' serving to resist rail overturning it will be understood that a complete rail-to-tie fastener assembly would require additional means to inhibit longitudinal rail creeping. Accordingly, suitable means such as the twin jaw rail anchor A shown in FIG. 1 may be applied to the rail base 17 adjacent one or both edges of the tie plate 3, in combination with either embodiment of the restraining blocks. Additionally, a tie pad P of any suitable well-known elastomeric composition may be disposed between the tie 6 and tie plate 3. With this arrangement it is not necessary to gouge or countersink the top of the tie for the reception of the fastener head 34 as in FIG. 1. As shown in FIG. 3, the inherent resilience of the pad P automatically accomodates the head of the fastener 32.

I claim:

1. A rail fastener including a restraining block and a tie plate, said tie plate provided with a rail seat section bounded by opposed shoulders, at least one said shoulder provided with a pair of spike holes disposed therethrough adjacent said rail seat section, said one shoulder having a curved upper surface, said block having a longitudinal extent overlying said pair of spike holes, a main body portion on said block spanning one said spike hole and including a lower curved bearing surface mating with said tie plate shoulder upper surface, said main body portion having a vertical hole therethrough vertically aligned above said one spike hole, an arm extending longitudinally from said main body portion toward said other spike hole, a lip portion extending inwardly from said main body portion and overlying a rail base flange disposed upon said rail seat section of said tie plate, anchor means extending from said main body and joining said block to both said spike holes, and said anchor means includes a multi-part fastener disposed through said one spike hole and aligned block hole and a lug depending from said arm and entering said other spike hole.

2. A rail fastener according to claim 1 wherein, said one tie plate shoulder includes a vertical face adjacent said rail seat section, and said pair of spike holes includes an inner surface vertically aligned with said shoulder face.

3. A rail fastener according to claim 1 wherein, said block lower curved bearing surface includes an outer portion adjacent an inner concave portion.

4. A rail fastener according to claim 1 wherein, said multi-part fastener includes a fixed base element extending through said one spike hole and block hole and projecting above said block, a head on said base element beneath said tie plate, and an applied element secured to the projecting portion of said base element atop said block.

5. A rail fastener according to claim 1 wherein, said block main body portion and arm include a planar top surface spanning both said spike holes.

6. A rail fastener according to claim 1 wherein, said lip portion includes a bottom surface spaced above said rail base flange, and a vertical shoulder on said block joined at its top to said lip bottom surface and at its bottom to said lower bearing surface.

7. A rail fastener according to claim 1 including, a separate anchor attached to said rail base adjacent at least one edge of said tie plate.

8. A rail fastener according to claim 1 including, a tie beneath said tie plate and a tie pad of elastomeric composition disposed between said tie plate and tie.

9. A rail fastener according to claim 1 wherein, said arm includes an undersurface disposed substantially above the medial height of said block.

10. A rail fastener according to claim 1 wherein, said lug includes a peripheral configuration providing a close fit within said other spike hole.

* * * * *